US007713176B1

(12) United States Patent
Farney

(10) Patent No.: US 7,713,176 B1
(45) Date of Patent: May 11, 2010

(54) RECUMBENT STEPPER EXERCISE MACHINE

(75) Inventor: Michael Kent Farney, Broken Arrow, OK (US)

(73) Assignee: Scifit Systems, Inc., Tulsa, OK (US)

( * ) Notice: Subject to any disclaimer, the term of this patent is extended or adjusted under 35 U.S.C. 154(b) by 1265 days.

(21) Appl. No.: 10/961,443

(22) Filed: Oct. 8, 2004

Related U.S. Application Data

(60) Provisional application No. 60/509,979, filed on Oct. 8, 2003.

(51) Int. Cl.
*A63B 21/00* (2006.01)
*A63B 69/06* (2006.01)

(52) U.S. Cl. ..... 482/52; 482/57; 482/62

(58) Field of Classification Search ..... 482/51–53, 482/57, 70–73
See application file for complete search history.

(56) References Cited

U.S. PATENT DOCUMENTS 4,708,338 A * 11/1987 Potts ..... 482/52
4,949,993 A * 8/1990 Stark et al. ..... 482/52
5,139,469 A * 8/1992 Hennessey et al. ..... 482/52
5,308,300 A * 5/1994 Chino et al. ..... 482/52
5,337,753 A 8/1994 Lekhtman
5,514,053 A * 5/1996 Hawkins et al. ..... 482/63
5,836,855 A * 11/1998 Eschenbach ..... 482/57
5,836,856 A * 11/1998 Mattoo et al. ..... 482/62
6,361,479 B1 * 3/2002 Hildebrandt et al. ..... 482/72
6,682,462 B1 * 1/2004 Lee ..... 482/72
6,932,745 B1 * 8/2005 Ellis ..... 482/52
7,267,639 B2 * 9/2007 Kuo ..... 482/62

* cited by examiner

*Primary Examiner*—Steve R Crow
(74) *Attorney, Agent, or Firm*—Fellers, Snider, Blankenship, Bailey & Tippens, P.C.

(57) ABSTRACT

A recumbent step exercise machine including a frame, a seat supported from the frame, and a drive mechanism supported from the frame. The drive mechanism includes a first and a second pedal, at least one axle shaft, at least one clutch, a speed increaser, and a brake. The first and the second pedal assemblies are each linked to at least one shaft by a linkage assembly. Each of the shafts are drivingly engaged to at least one clutch. The linkage assemblies act as levers that translate the reciprocating motion of the pedal assemblies into rotational motion of the shaft. Each linkage assembly extends downwardly from the shaft to which it is drivingly engaged and terminates with the pedal assembly. A first and a second arm mechanism may be linked through the linkage assembly to the first and second pedal assembly.

16 Claims, 7 Drawing Sheets

RECUMBENT STEPPER EXERCISE MACHINE

CROSS-REFERENCE TO RELATED APPLICATION

This application claims the benefit of U.S. Provisional Application Ser. No. 60/509,979 filed on Oct. 8, 2003.

BACKGROUND OF THE INVENTION

1. Field of the Invention

The present invention relates generally to exercise equipment. More specifically, the present invention relates to the field of stair climbing, or stepper, exercise machines.

2. Background of the Invention

Many different designs of equipment exist for the purpose of physical exercise and physical therapy. One such type, stair climbing machines, or steppers, simulate climbing stairs or steps. With such machine designs know in the industry, the user typically places his or her feet on a pair of pedals and begins to alternately raise his or her legs as if he or she were climbing a flight of stairs. The pedals respond by raising and applying a load resistance which the user must overcome to lower the pedal. The amount of resistance is determined by the weight and/or fitness level of the user. Steppers are known to provide a superior low impact workout for therapy, rehabilitation or cardiovascular conditioning for the amount of time spent by the user on the machine.

One problem with stair climbing machines known in the art is that such steppers require the user to be standing in order to operate the machines. This limitation restricts usage to those who are physically capable of standing during exercise and are thus less than optimal for physical therapy and rehabilitation use. A need, therefore exists for a stepper type exercise device which can be operated in a seated position by those who are unable to stand.

Alternatively, people who are less fit have been know to find stair climbing machines to be too difficult to operate for extended periods of time. In such cases, workouts tend to be shortened, thereby also reducing the aerobic benefit of the workout. A need, therefore, also exists for a stepper type exercise device which allows users who are less physically fit to achieve a sustained cardiovascular workout.

A related limitation is that since the user is in a standing position, the user can effectively use his or her body weight alone to overcome the resistance required to lower the pedal. In this manner, the aerobic benefit of the workout is reduced. As a result, a need exists for a stepper type exercise device which is not responsive to the weight of the user.

SUMMARY OF THE INVENTION

The recumbent step exercise machine of the present invention includes, generally, a frame, a seat supported from the frame, and a drive mechanism supported from the frame. The drive mechanism includes a first and a second pedal, at least one axle shaft, at least one clutch, a speed increaser, and a brake.

The first and the second pedal assemblies are each linked to at least one shaft by a linkage assembly. Each of the shafts are drivingly engaged to at least one clutch, each of which is, in turn, in driving engagement with the brake.

The pedal assemblies include a footbed to receive the foot of the person operating the machine and a platform to which it is affixed. The platform is pivotally attached to the linkage assembly.

The linkage assemblies are essentially levers which translate the reciprocating motion of the pedal assemblies into rotational motion of the shaft. Each linkage assembly extends downwardly from the shaft to which it is drivingly engaged and terminates with the pedal assembly. This allows the working mechanism of the machine, the drive mechanism, to be substantially upright supported by the frame, to allow step-through space between the seat and the housing enclosing the drive mechanism.

In operation, the pedal assemblies are activated by a person seated in the seat in a manner known in the industry to be recumbent. Reciprocation of the pedal assemblies rotate, or drive, a shaft through the linkage assembly. There could be a single shaft or a shaft driven by each pedal assembly. The clutch, or clutches in the case of multiple shafts, sum the driving rotational motion derived from reciprocation of each pedal assembly which is drivingly engaged with the speed increaser.

The speed increaser acts to increase the speed of driving rotation obtained from activation of the pedal assemblies and is drivingly engaged with the brake. The brake, in turn provides resistance to the drive mechanism to vary the intensity of the workout for the user of the machine.

The recumbent configuration of the present invention allows for accurate measure of the amount of work performed by the person using the machine. This is because the body weight of the person rests on the seat and not the pedals.

A first and a second arm mechanism may be linked, preferably through the linkage assembly, to the first and second pedal assembly, respectively, in an alternate embodiment. In this embodiment, the arm mechanisms combine sum with the pedal assemblies to drive the speed increaser.

A display of the type known in the industry is electrically connected to the brake and receives raw data from the brake. The display then computes and provides certain information to the user in a known manner. The brake provides the electrical energy required to operate the display.

It is an object of the present invention to provide a recumbent step exercise machine which provides a low impact aerobic workout for therapy, rehab, or cardiovascular conditioning. It is still a further object of the present invention to provide such a recumbent step exercise machine which may also arm mechanisms to provide an upper body workout.

It is a further object of the present invention to provide a recumbent step exercise machine which translates energy expended through reciprocation to electrical energy and/or resistance energy.

A yet further object of the present invention is to provide a recumbent step exercise machine which translates such motion through the use of linkage assembly which extends downward from a shaft and terminates with a pedal assembly.

Additional objects and advantages of the present invention will become apparent to those skilled in the art to which this invention relates from the accompanying drawings taken in conjunction with the following detailed description of the preferred embodiment and the claims.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

DESCRIPTION OF THE PREFERRED EMBODIMENTS

Before describing the preferred embodiment of the present invention in detail, it is important to understand that the invention is not limited in its application to the details of the construction illustrated and the steps described herein. The invention is capable of other embodiments and of being practiced or carried out in a variety of ways. It is to be understood that the phraseology and terminology employed herein is for the purpose of description and not of limitation.

Figure 1:
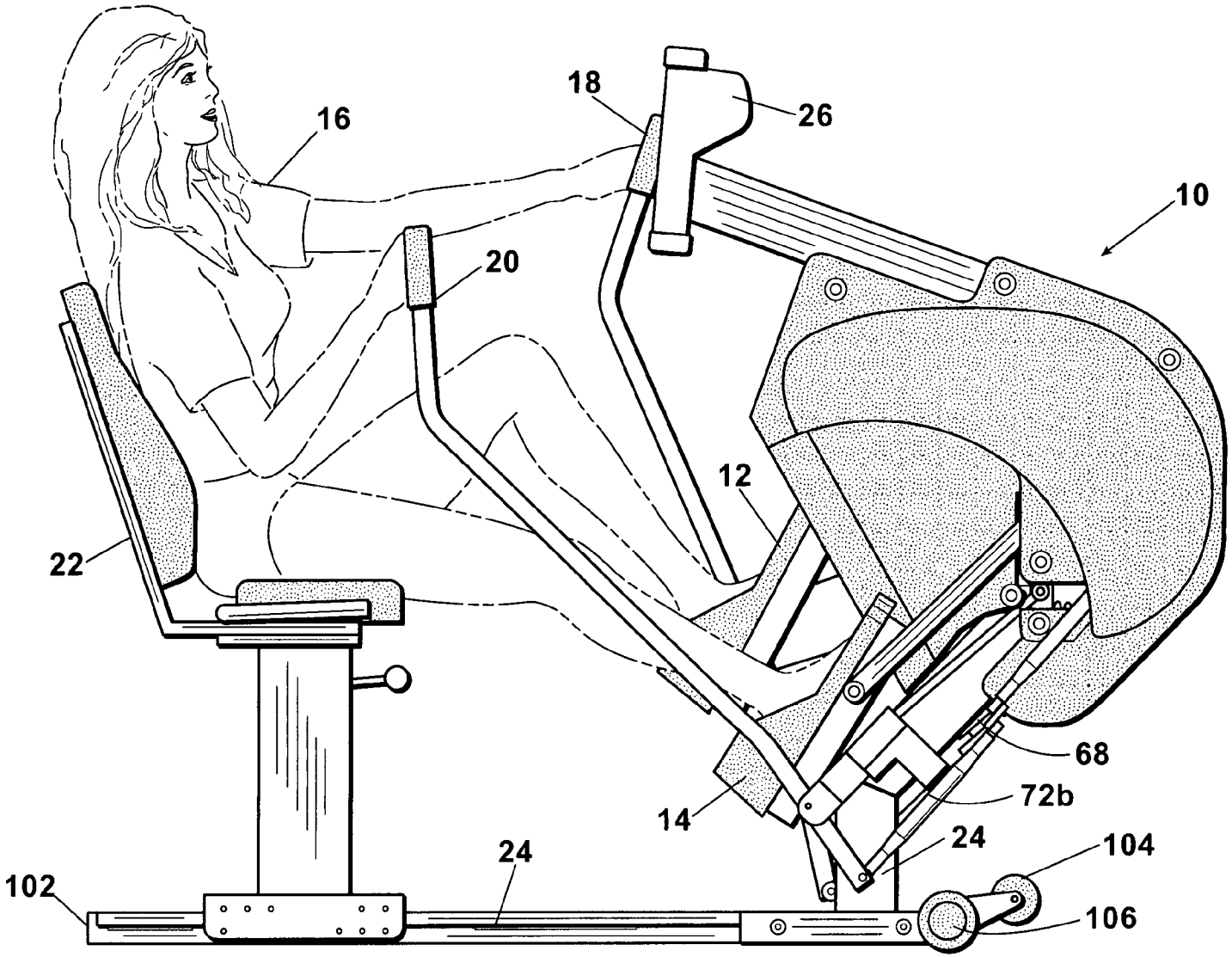
FIG. 1 is a side view of the recumbent step exercise machine of the present invention.
Figure 2:
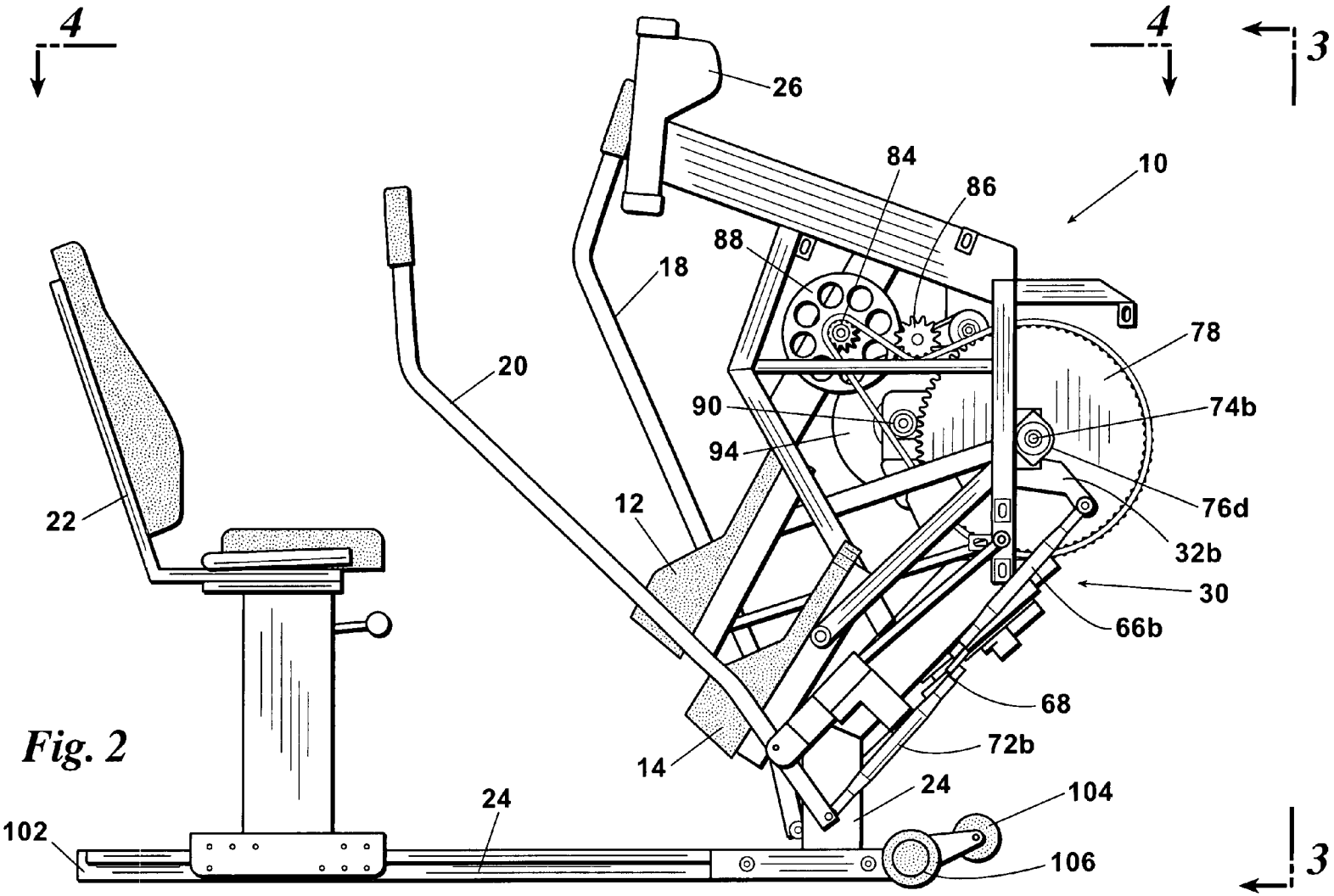
FIG. 2 is a side view of the recumbent step exercise machine of the present invention with its external cover removed.

Referring now to the drawings, wherein like reference numerals indicate the same parts throughout the several views, the inventive recumbent step exerciser 10 is shown in its general environment in FIG. 1. In a preferred embodiment, exerciser 10 comprises: a pair of pedal assemblies 12 and 14 which are alternatingly pushed down and away from the user 16; a pair of arm mechanisms 18 and 20 which are pulled toward the user 16; a seat 22 to support the user 16 during a workout; a frame 24 which generally supports exerciser 10; and display unit or console 26 which allows the user 16 to select the degree of resistance applied to pedal assemblies 12 and 14 and arm mechanisms 18 and 20, and provide feedback to the user, both in instantaneous values, i.e., METS, watts, heart rate, steps per minute, etc., and totalized values, i.e., calories, steps taken, etc. Cover 28 protects internal components of exerciser 10 from dust, sweat, and other contaminants, as well as protecting people from moving parts within exerciser 10 and providing a pleasing appearance.

Figure 7:
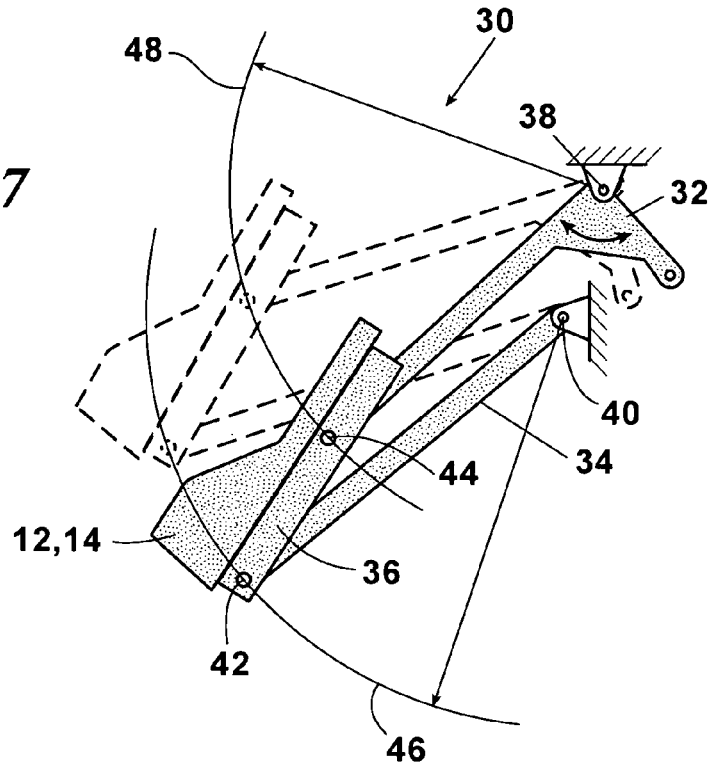
FIG. 7 is a schematic representation depicting the path of travel of a pedal assembly of the recumbent step exercise machine of the present invention.

Pedal assemblies 12 and 14 are each connected to frame 24 through a four-bar linkage assembly which controls articulation of the associated pedal over its range of motion. Turning to FIG. 7, four-bar linkage assembly 30 comprises: crank 32; lower link 34; pedal support 36 connected to crank 32 and link 34 at pivots 42 and 44; and frame 24 (FIG. 1), which fixes the relative positions of pivots 38 and 40. As will be appreciated by those skilled in the art, by judicious selection of the relative lengths of the members of four-bar linkage assembly 30, the degree to which the angle of pedal assemblies 12 or 14 varies depends on the arc 46 traversed by pivot 42 and the arc 48 traversed by pivot 44 over the range of pedal assemblies 12 and 14.

Figure 8:
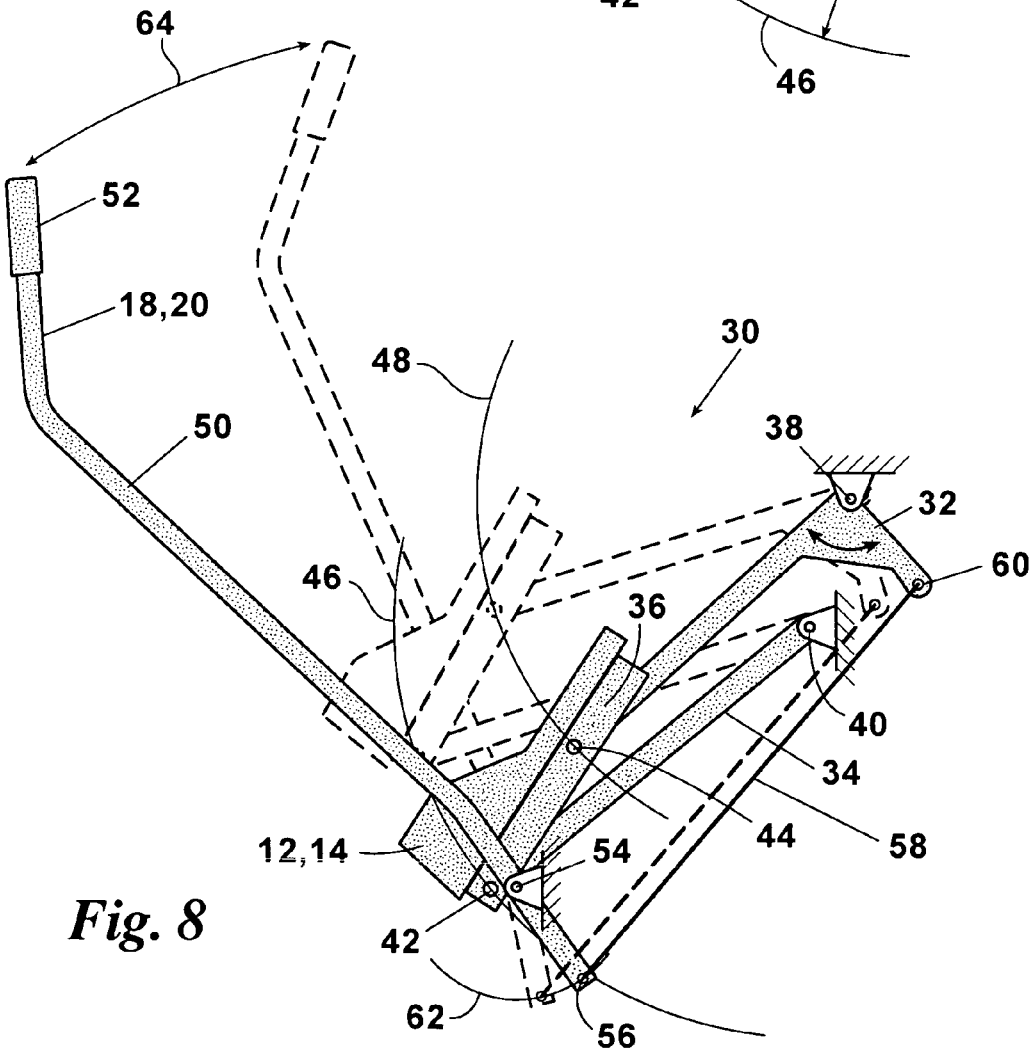
FIG. 8 is a schematic representation depicting the path of travel of a pedal assembly with an arm mechanism attached to the recumbent step exercise machine of the present invention.

Referring next to FIG. 8, in a preferred embodiment the movement of arm mechanisms 18 and 20 is coordinated with the movement of pedal assemblies 12 and 14, respectively. Arm mechanisms 18 and 20 include: bar 50; hand grip 52 covering bar 50 at its upper end; an aperture (not shown) through bar 50 at pivot point 54; and aperture 56 at the lower end of bar 50. Link 58 ties the lower end of bar 50 to aperture 60 of crank 32 such that, as pedal 12 or 14 traverses arcs 46 and 48 in a downward and forward, crank 32 pulls link 58 to move the lower end of handle bar 18 or 20 along arc 62 in a generally forward direction. In turn, the upper end of bar 50 moves along arc 64 in a generally rearward direction. When the direction of pedal 12 or 14 reverses, the direction of movement of grip 52 likewise reverses.

Turning next to FIGS. 2-5, once a pedal 12 or 14 is pushed forward by the user, there must be a method in place to return the pedal to its initial position. Two schemes are well known in the art. First, a spring could be attached to each pedal to return the pedal for the next cycle. This type of system is referred to as an independent system since movement of one pedal is independent of the movement of the opposite pedal.

Alternatively, forward movement of one pedal can be used to return the other pedal to its starting position. This type of system is sometimes referred to as a dependent system because the position of one pedal is dependent on the position of the other pedal. While the present invention is well adapted to be practiced in either an independent movement or a dependent movement, the dependent system has a number of advantages in terms of the mechanics of the exercise machine relative to the user. By way of example and not limitation, a pedal return spring would return to the user a portion of the energy expended in the workout, reducing the accuracy with which the work can be measured. Further, it is well known in the art that, particularly aerobic machines in a health club setting may endure many hours of use per day. In past machines, spring breakage has been a problem under such use.

The pedal return mechanism of the present invention includes: pivot bar 68 pivotally attached to frame 24 at pivot 70; forward link 66*a* pivotally attached between left crank 32*a* and the left end of pivot bar 68; and forward link 66*b* pivotally attached between right crank 32*b* and the right end of pivot bar 68. Rearward links 72*a* and 72*b* continue rearwardly from each end of pivot bar 68 to arm mechanisms 18 and 20, respectively, to complete the link from cranks 32*a* and 32*b* to bars 18 and 20. By way of example, as pedal 12 is pushed down, crank 32*a* acts to pull the associated forward link 66*a* forward and, in turn, the left end of pivot bar 68 forward. As a result, the right end of pivot bar 68 is pushed rearward, pulling the opposite link 66*b* and rotating the other crank 32*b* to return the pedal 14 to its initial position. Pushing pedal 14 reverses the process to return pedal 12 to its initial position. It should be noted that the machine will assume the appropriate range of motion for a particular user since the user controls the return height of one pedal by the depth to which the opposite pedal is pushed.

It should be noted that terms of position, such as forward, rearward, left, right, etc., are indicate position from the perspective of a user of the machine.

Figure 3:
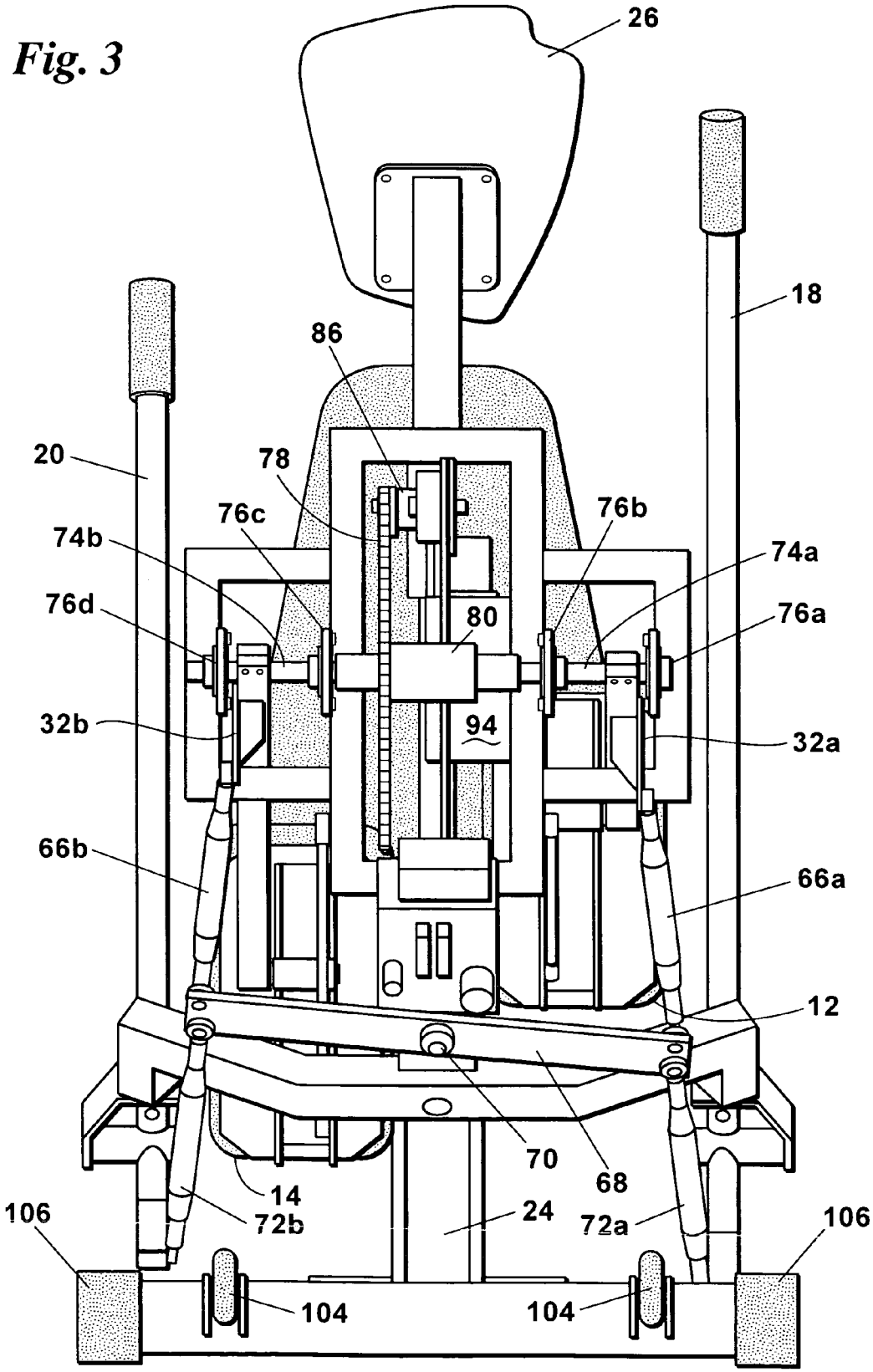
FIG. 3 is a front view of the recumbent step exercise machine of the present invention with its external cover removed.
Figure 4:
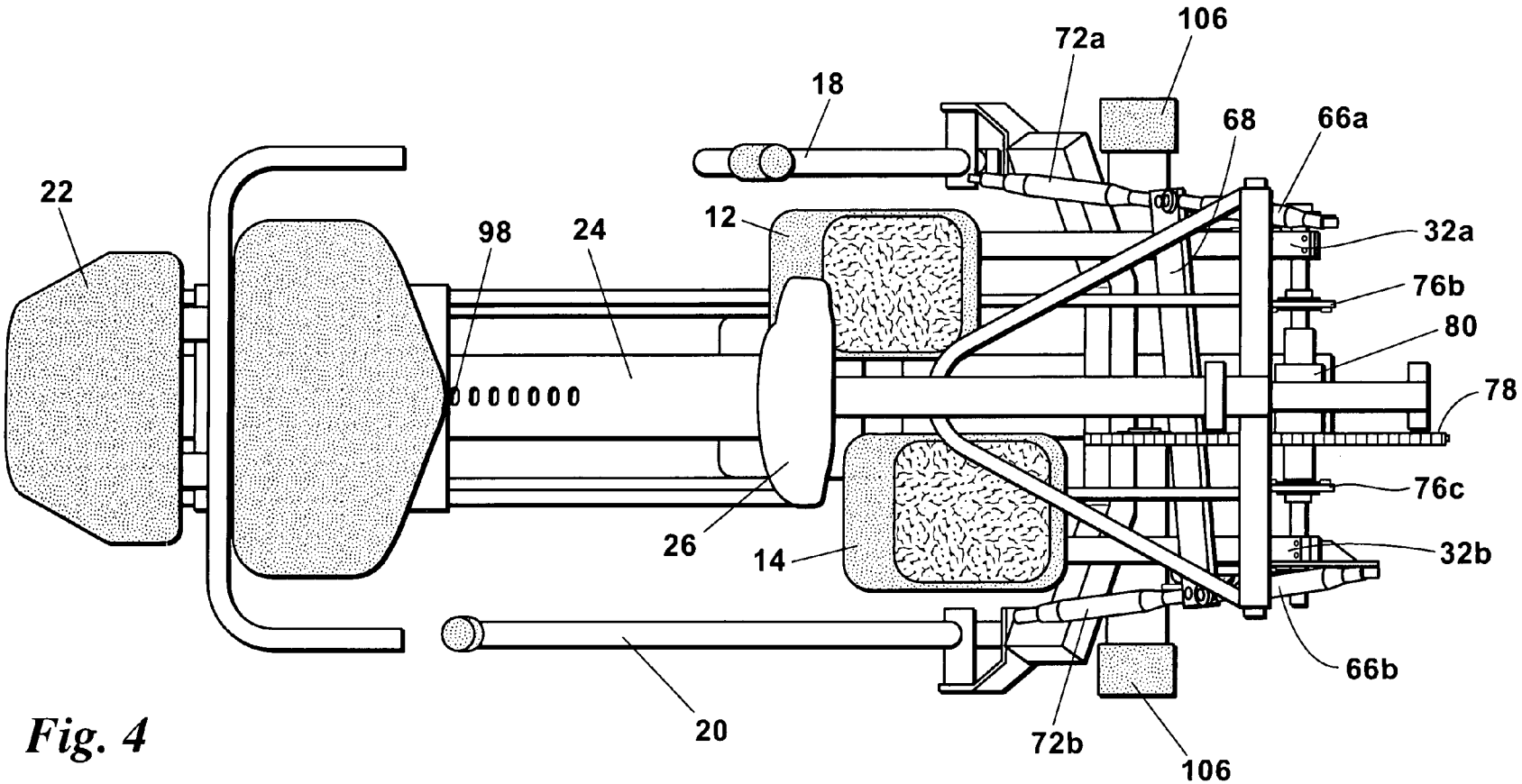
FIG. 4 is a plan view of the recumbent step exercise machine of the present invention with its external cover removed.

To provide resistance to the user, work performed by the user, either through pushing the pedal assemblies, or pushing and/or pulling the arm mechanisms, is converted to a continuous rotation and used to drive a brake. As discussed above, movement of pedal assemblies 12 and 14, and/or arm mechanisms 18 and 20, results in rotation of the corresponding cranks 32*a* and 32*b*. As best seen in FIG. 3, crank 32*a* is clamped to axle 74*a* so that a rotation of crank 32*a* results in a like rotation of axle 74*a*. Axle 74*a* is supported from frame 24 by pillow block bearings 76*a* and 76*b*. In a like fashion, crank 32*b* is clamped to axle 74*b* so that rotation of crank 32*b* causes a like rotation of axle 74*b*. Axle 74*b* is supported from frame 24 by bearings 76*c* and 76*d*. Input sprocket 78 is rotationally supported from axles 74*a* and 74*b*. A pair of overrun clutches (not shown) are housed within the hub 80 of sprocket 78, positioned such that one clutch acts on axle 74*a* while the other clutch acts on axle 74*b*. In the preferred embodiment, the clutches are oriented in hub 80 such that either clutch drives sprocket 78 in response to counterclockwise rotation (as viewed from the perspective of FIG. 2) of its corresponding axle 74*a* or 74*b* and overruns in response to clockwise rotation. Thus, when user 16 pushes on a pedal 12 or 14, sprocket 78 is driven in a counterclockwise direction. Meanwhile, the opposite pedal is pushed towards the user and the clutch acting on the associated axle overruns. Thus continuous alternating movement of the pedal assemblies by a user will result in continuous rotation of sprocket 78 in one direction. It should be noted that, in light of the dependent nature of the pedal action, both clutches could be reversed and the machine would operate identically except that sprocket 78 would rotate in the opposite direction. Overrun clutches are well known in the art.

Sprocket 78 drives a speed increaser which increases the rate of rotation to a speed which is suitable for braking. In the preferred embodiment, the rotational speed is increased through a combination of sprockets and chain, and belts and pulleys. A first increase in rotational speed is obtained through the driving of sprocket 84 by chain 82, which is in turn driven by sprocket 78. Idler 86 is spring loaded to maintain an appropriate level of tension in chain 82. Sprocket 84 is affixed to pulley 88 such that pulley 88 rotates at the same rotational speed as sprocket 84. A second increase in rotational speed is obtained by driving pulley 90 with belt 92, which is in turn driven by sprocket 88. The rotor of brake 94 is driven directly by pulley 90. As will be apparent to those skilled in the art, the important aspect of the speed increaser is the overall ratio of input speed at sprocket 78 to the output speed at brake 94. Many alternative methods exist for achieving a similar gain in rotational speed such as through a gear box or transmission, using more or less pairs of sprockets and chains/belts, etc.

Figure 5:
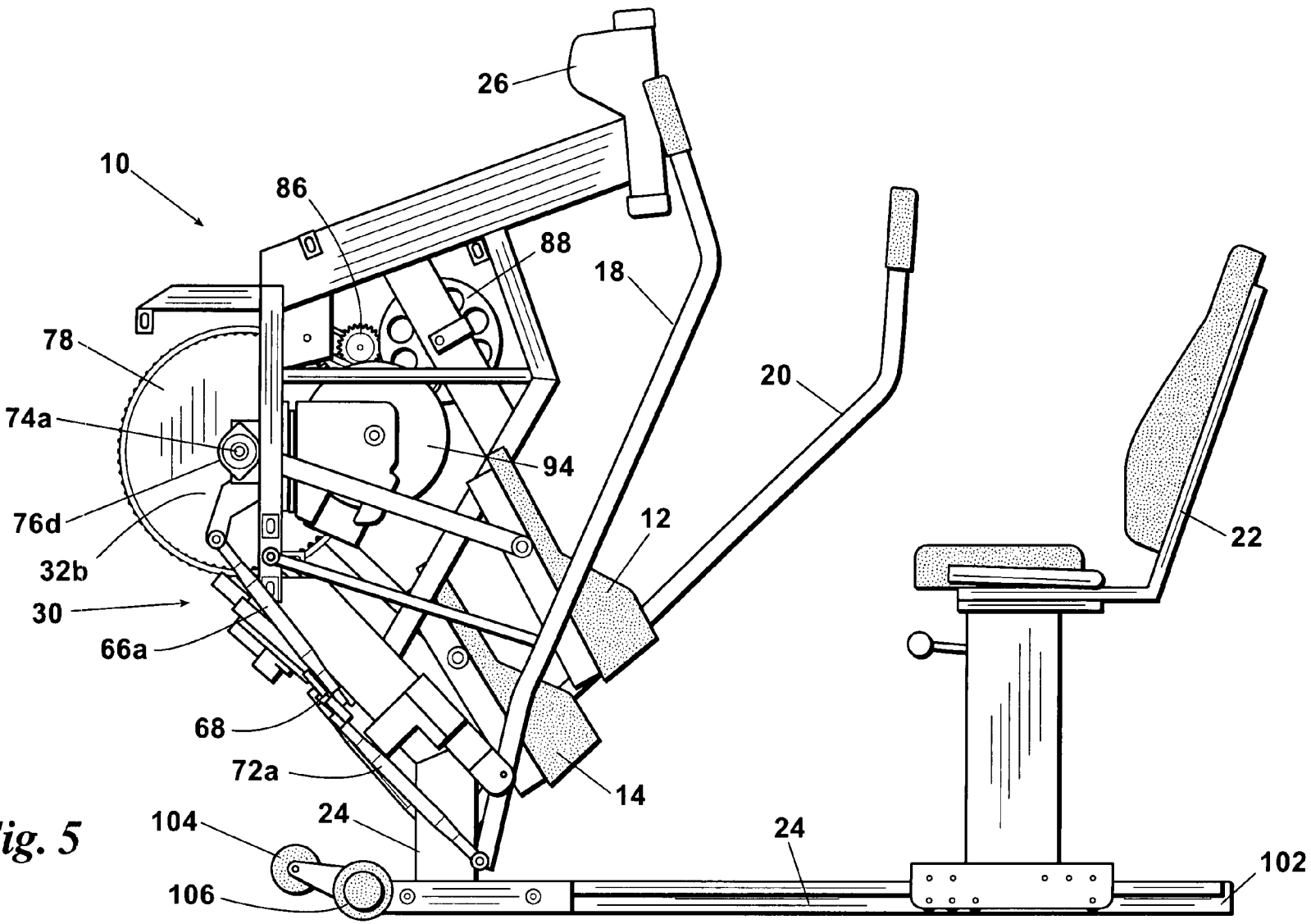
FIG. 5 is a side view of the recumbent step exercise machine of the present invention taken from the side opposite FIG. 2 with the cover removed.

Referring to FIG. 5, in the preferred embodiment brake 94 is a dual-acting brake in that braking force may be applied either through the generation of electrical power, and its subsequent dissipation in a load, or through eddy current braking. The present brake offers an advantage that the inventive exerciser 10 may be used in a stand-alone mode. As a stand-alone device, exerciser 10 includes a rechargeable battery (not shown). As a user begins using the machine, initially console 26 is receives electrical power from the battery. As the exerciser begins to exercise, electrical power generated by brake 94 is used to recharge the battery and to power console 26. Under the control of console 26, if more resistance is need than is provided by the generation of electricity for operation of the machine, the eddy current function of brake 94 is activated to increase the mechanical resistance applied by brake 94 without generating excess electricity which would have to be switched through a load resistor. A number of alternative braking means are suitable for use in the present invention, including by way of example and not limitation, an electrical generator, or alternator, in combination with a load resistor, an eddy current brake, a magnetic particle brake, a friction brake, or the like.

Figure 6:
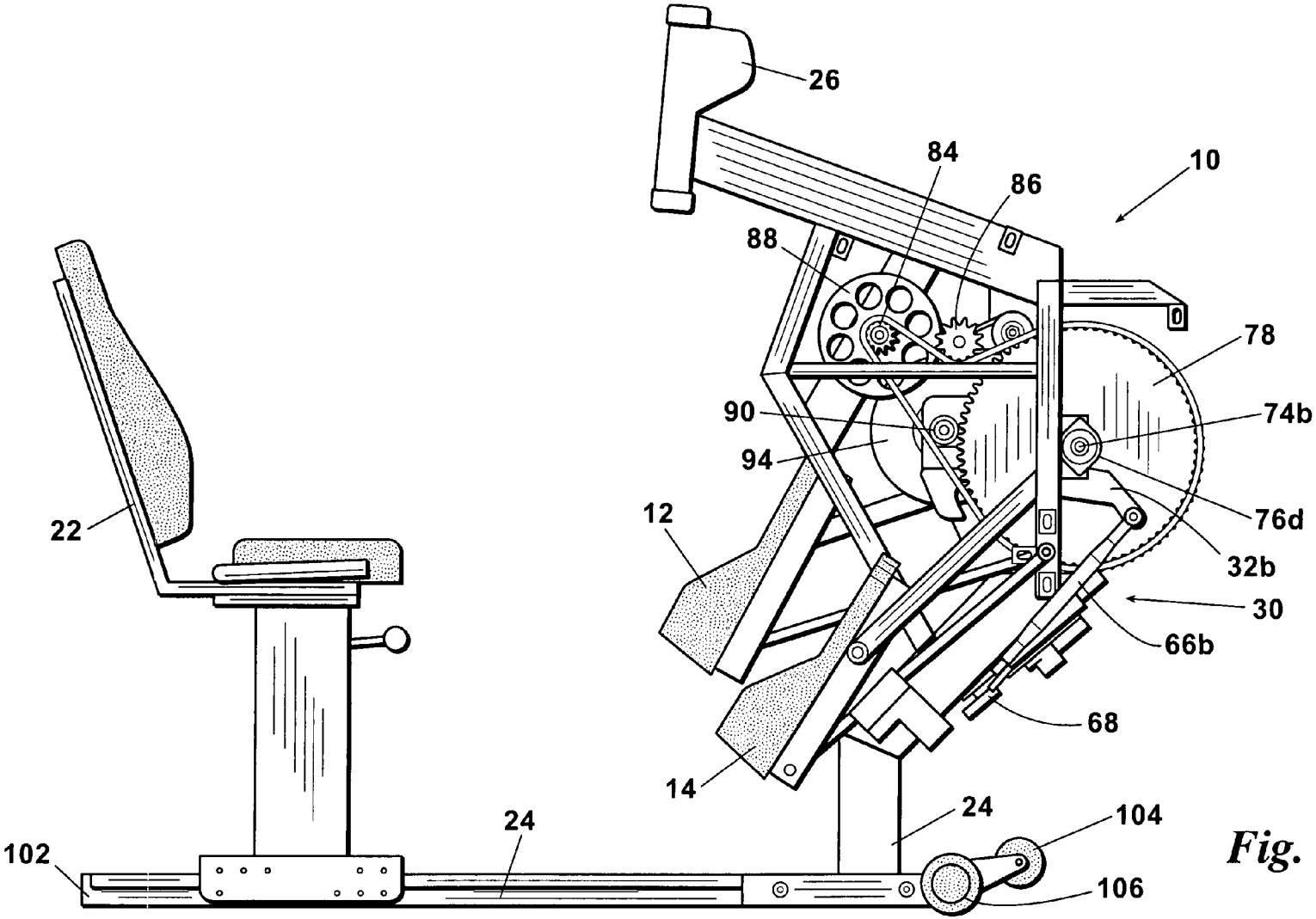
FIG. 6 is a side view of a basic embodiment of the recumbent step exercise machine of the present invention without the arm mechanisms and the external cover removed.

Referring now to FIG. 6, in a basic alternate embodiment, exerciser 100 may be configured to provide only a lower body exercise. As in the above described embodiment, exerciser 100 includes pedal assemblies 12 and 14 connected to a four-bar mechanism 30 to rotationally drive sprocket 78 in response to the user manipulating pedal assemblies 12 and 14. Through the summing of rotational movement through overrun clutches, and an increase in rotational speed through the speed increaser, sprocket 78 drives brake 94. Preferably the pedal assemblies of exerciser 100 are operated in a dependent manner through the interaction of crank 32*b*, link 66*b*, pivot bar 68 and like components located on the opposite side of exercise machine 100.

With reference once again to FIGS. 1 and 4, it should be noted that preferably exercise machine 10 includes an adjustable seat 22 to allow user 16 to place the seat at a comfortable position relative to pedal assemblies 12 and 14. Seat adjustment is accomplished by moving lever 96 and moving seat 22 to the desired position. Releasing lever 96 allows a pin (not shown) to index in a hole, such as hole 98, in frame 24 to lock seat 22 at the selected position.

Exercise machine 10 can be moved by raising back end 102 to bring wheels 104 into contact with the floor. When in place, exerciser 10 rests on feet 106, which are formed of rubber, or a similar material, to prevent unwanted movement of the machine during use.

What is claimed is:

1. A recumbent step exercise machine, comprising:

a frame;

a seat supported from said frame;

a drive mechanism supported on said frame such that said seat is spaced from said drive mechanism so as to provide step-through space between said seat and said drive mechanism;

said drive mechanism including:

a first pedal assembly linked to a first axle shaft;

said first axle shaft being engaged with a first clutch;

a second pedal assembly linked to a second axle shaft;

said second axle shaft being engaged with a second clutch; said first clutch and said second clutch being in driving engagement with a speed increaser;

said first pedal assembly and said second pedal assembly being dependent such that a user depressing said first pedal assembly will cause the second pedal assembly to be pushed toward said user and alternately said user pushing said second pedal assembly will cause said first pedal assembly to be pushed toward said user;

a brake drivingly engaged with said speed increaser for providing resistance to said drive mechanism.

2. The exercise machine of claim 1 including a first arm mechanism and a second arm mechanism.

3. The exercise machine of claim 2 wherein said first arm mechanism is linked to said first pedal assembly and said second arm mechanism is linked to said second pedal assembly.

4. The exercise machine of claim 1 wherein said first pedal assembly is linked to said first axle shaft through a first four-bar linkage and said second pedal assembly is linked to said second axle shaft through a second four-bar linkage.

5. The exercise machine of claim 4 further including:

a first arm mechanism linked to said first four-bar linkage;

a second arm mechanism linked to said second four-bar linkage.

6. The exercise machine of claim 1 further including a visual display electrically connected to said brake.

7. The exercise machine of claim 1 wherein said speed increaser includes:

a first sprocket in driving engagement with said at least one clutch;

a second sprocket in driving engagement with said brake;

a chain in driving engagement with and extending between said first sprocket and said second sprocket.

8. The exercise machine of claim 1 wherein said speed increaser includes:

a first sprocket in driving engagement with said at least one clutch;

a second sprocket;

a chain in driving engagement with and extending between said first sprocket and said second sprocket;

said second sprocket secured to a first pulley; a second pulley affixed to said brake;

a belt in driving engagement with and extending between said first pulley and said second pulley.

9. An exercise machine, comprising:

a frame;

a seat supported from said frame;

a drive mechanism supported from said frame;

said drive mechanism including:

at least one axle shaft;

a first linkage assembly formed by a first crank extending between said frame and a first pedal assembly and a first lower link extending between said frame and said first pedal assembly;

said first pedal assembly linked to at least one of said at least one axle shaft by said first linkage assembly;

said first crank of said first linkage assembly extending downwardly from said at least one axle shaft to said first pedal assembly;

a second linkage assembly formed by a second crank extending between said frame and a second pedal assembly and a second lower link extending between said frame and said second pedal assembly;

said second pedal assembly linked to at least one of said at least one axle shaft by said second linkage assembly;

said second crank of said second linkage assembly extending downwardly from said at least one axle shaft to said second pedal assembly;

at least one clutch;

each of said at least one axle shaft being engaged with at least one of said at least one clutch;

a speed increaser in driving engagement with said at least one clutch;

a brake drivingly engaged with said speed increaser for providing resistance.

10. The exercise machine of claim 9 further including:

a first arm mechanism linked to said first linkage assembly;

a second arm mechanism linked to said second linkage assembly.

11. The exercise machine of claim 9 wherein said speed increaser includes:

a first sprocket in driving engagement with said at least one clutch;

a second sprocket;

a chain in driving engagement with and extending between said first sprocket and said second sprocket;

said second sprocket secured to a first pulley; a second pulley affixed to said brake;

a belt in driving engagement with and extending between said first pulley and said second pulley.

12. The exercise machine of claim 9 wherein said first pedal assembly and said second pedal assembly are dependent.

13. The exercise machine of claim 9 wherein said seat is spaced from said drive mechanism so as to allow step through space between said seat and said drive mechanism.

14. The exercise machine of claim 1 wherein said first pedal assembly and said second pedal assembly are dependent.

15. The exercise machine of claim 1 further including:

said first pedal assembly linked to said first axle shaft by a first linkage assembly;

said first linkage assembly extending downwardly from said first axle shaft to said first pedal assembly;

said second pedal assembly linked to said second axle shaft by a second linkage assembly;

said second linkage assembly extending downwardly for said second axle shaft to said second pedal assembly.

16. The exercise machine of claim 15 further including:

a first arm mechanism linked to said first linkage assembly;

a second arm mechanism linked to said second linkage assembly.

* * * * *